US005846376A

United States Patent [19]

Gossett et al.

[11] Patent Number: 5,846,376

[45] Date of Patent: Dec. 8, 1998

[54] ADHESIVE CONSUMPTION MONITORING SYSTEM

[75] Inventors: Scott Gossett; Robert Lantz; Steven Petrila; Carl Tallarovic, all of Chicago, Ill.

[73] Assignee: The Ringwood Company, Chicago, Ill.

[21] Appl. No.: 520,407

[22] Filed: Aug. 29, 1995

[51] Int. Cl.[6] ..... B31F 1/20

[52] U.S. Cl. ..... 156/356; 156/378; 156/462; 156/512; 156/578; 156/580

[58] Field of Search ..... 156/64, 356, 578, 156/205, 378, 462, 580, 510, 512

[56] References Cited

U.S. PATENT DOCUMENTS

| | | | |
|---|---|---|---|
| 4,316,755 | 2/1982 | Flaum et al. | 156/578 |
| 4,369,080 | 1/1983 | Johnson | 156/356 |
| 4,806,183 | 2/1989 | Williams | 156/356 |
| 5,415,720 | 5/1995 | Schonhammer et al. | 156/578 |
| 5,628,868 | 5/1997 | Marschke et al. | 156/578 |

*Primary Examiner*—Richard Crispino
*Attorney, Agent, or Firm*—Laff, Whitesel, Conte & Saret, Ltd.

[57] ABSTRACT

A paper corrugator machine has a closed loop for delivering warm adhesive from a source to a pan from which the adhesive is applied onto the crests of the corrugated paper flutes. To insure a delivery of the correct amount of adhesive to the flute crests, a predetermined amount of adhesive is first accumulated in a graduated column. Then, the adhesive delivery feed is switched from the closed loop to the graduated column. A detector senses upper and lower limits of the amount of the adhesive in the column. The rate of the delivery of adhesive is determined by how long it takes for the predetermined amount of adhesive to be delivered from the column to the corrugating machine. Responsive to this determination, the corrugating machine may be adjusted to apply more or less adhesive to the flute crests.

9 Claims, 5 Drawing Sheets

ADHESIVE CONSUMPTION MONITORING SYSTEM

This invention relates to high speed cardboard or paper corrugators and more particularly to means for monitoring the consumption of adhesive and for adjusting the corrugator in response to the monitoring.

Corrugators are machines which form layers of paper sheets into flutes and then glue smooth liner sheets to the crests of the flutes. For this gluing, it is important for the correct amount of adhesive to be applied to the crest of each flute. Too little adhesive will result in a faulty corrugated product which may fail, possibly causing expensive damage to products packed in or used with corrugated paper.

Too much adhesive will result in costly production. Also, since the adhesive contains large amounts of water, too much adhesive means that too much water is applied to the paper which, in turn, may cause a warpage of the corrugated board end-product, extend the drying time, and slow production. Accordingly, it is necessary to isolate and accurately measure the flow and consumption of adhesive to the adhesive station.

It is desirable to automatically carry out these consumption monitoring measurements, at a push of a button, under the control of an electronic logic circuit. Preferably, the logic circuit monitors four things during these measurements: (1) the amount of adhesive used; (2) the amount of time required to use the measured amount of adhesive; (3) the amount of finished corrugated board produced during the utilization of the measured amount of adhesive; and (4) the speed at which the corrugator is running during the test. However, in its simplest form, the monitor system may measure either the time required to dispense a given amount of adhesive or the amount of adhesive dispensed during a given amount of time. By comparing these variables, it is possible to determine the amount of adhesive applied to the crests of the corrugation flutes. From this comparison, a gap between the application roller and a metering roller of the corrugator may be adjusted in order to apply more or less adhesive to the crests.

Another consideration is the speed of the corrugators. Over the recent past, the speed of the corrugators has increased substantially as compared to the former speed of corrugators. Automatic controls are almost inherent requirements for this recent increase and to a continued increase in the corrugator speed. High on the list of automatic controls are those dealing with the delivery of the adhesive to the corrugator and adjustments of various gaps at locations in the production equipment where the adhesive is applied.

In the past, the consumption of adhesive measurements have been carried out manually by people using hand tools, such as buckets and the like. The adjustments to the adhesive delivery system and to the corrugators have been done manually in order to apply the correct amount of adhesive. This manual testing, and adjustment, and retesting was followed by more readjustment which has required excessive amount of delay.

Therefore, an object of this invention is to provide new and improved means for and methods of monitoring the consumption of adhesive in a corrugator.

In keeping with an aspect of the invention, this and other objects of the invention are provided by a graduated test column equipped with a level detector. A starch adhesive is pumped into this test column where the level of the adhesive in the column is continuously monitored. Then, the starch adhesive is taken from the column and put into a closed re-circulation loop preferably in response to an operation of automatic valves. The inventive system is controlled through the use of a programmable logic controller which responds to the level and rate of depletion of the starch in the test column.

BRIEF DESCRIPTION OF THE DRAWINGS

A preferred embodiment of the invention is shown in the attached drawings, in which:

FIG. 1 schematically shows an example of a double face corrugator having a roll 20 of a first smooth paper liner, a roll 22 of paper destined to become a fluted sheet (medium), a first pan 24 for applying an adhesive to the crests of the flutes on the sheet drawn from roll 22, a second pan 26 for applying adhesive to opposing crests of the same flutes for receiving a second smooth backing liner. Thereafter, the assembled corrugated paper preferably goes by several steam chest heaters 28, which are internally heated by steam, in order to gelatinize and dry the adhesive. Then the finished corrugated board is cut into discrete sheets by a knife 30.

The web 32 that is corrugated is pulled from roll 22 and passed through a nip between two steam heated steel rolls or drums 34, 36 having surfaces with grooves and ridges in the size, shape, and form of the fluted portion of corrugated board. As the web 32 passes through the nip between rolls or drums 34, 36, it is shaped into flutes which cover the surface of roll 34. The pan 24 has a warm (about 100°–110° F.) liquid adhesive therein. An application roller 38 picks up adhesive from the surface of the liquid in pan 24 and applies it to the upper crests 41 of the flutes on the paper wrapping roll 34. A metering roller 40 regulates the amount of adhesive on the application roller 38 in order to apply exactly the correct amount of adhesive. FIG. 1B shows the correct amount of adhesive 39 on crest 41 of web 32.

Figure 1:
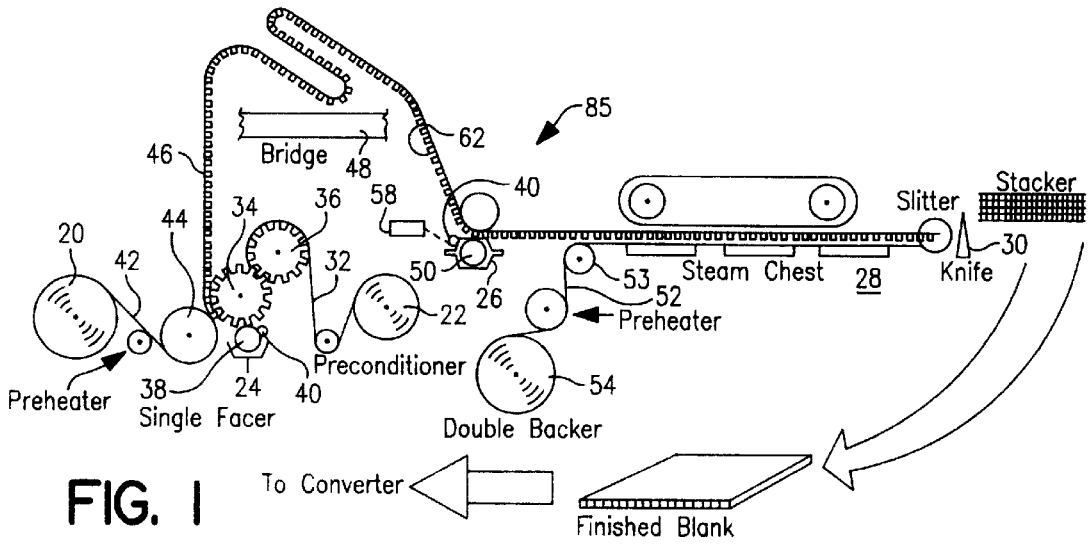
FIG. 1 schematically shows a corrugator.

The smooth liner web 42 is pulled from roll 20 and passed over a pressure roll 44 which presses the liner against the adhesive on the paper flutes. The resulting single faced corrugated board 46 is accumulated in buffer storage on a bridge 48.

Figure 1A:
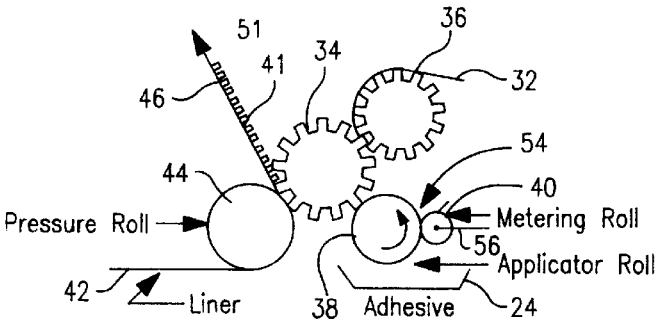
FIG. 1A is an enlarged detail taken from FIG. 1.

To make a double face corrugated board, the single face board is pulled from its buffer storage on bridge 48 and passed a second application roller 50, in adhesive pan 26, which applies adhesive to the lower crests 51 (FIG. 1A) of the fluted paper. Thereafter, a second smooth liner web 52 is pulled from a roll 54 and pressed by a pressure roller 53 against the adhesive on the lower crests 51. Then the adhesive on the upper and lower crests is gelatinized and dried by heat from the steam chest heaters 28 and corrugator rolls 34, 36.

The application rollers 38, 50 are positioned to pick up a coating of the adhesive which is applied onto the crests 41, 51 of the fluted material. Hence, it is necessary to adjust a gap 54 (FIG. 1A) between the application rollers 38, 50 and their associated metering rollers 40. That gap may be adjusted manually (symbolically by a suitable handle 56 (FIG. 1A)) or by driving a servo system 58 (FIG. 1) under control of a program control logic circuit.

Figure 6:
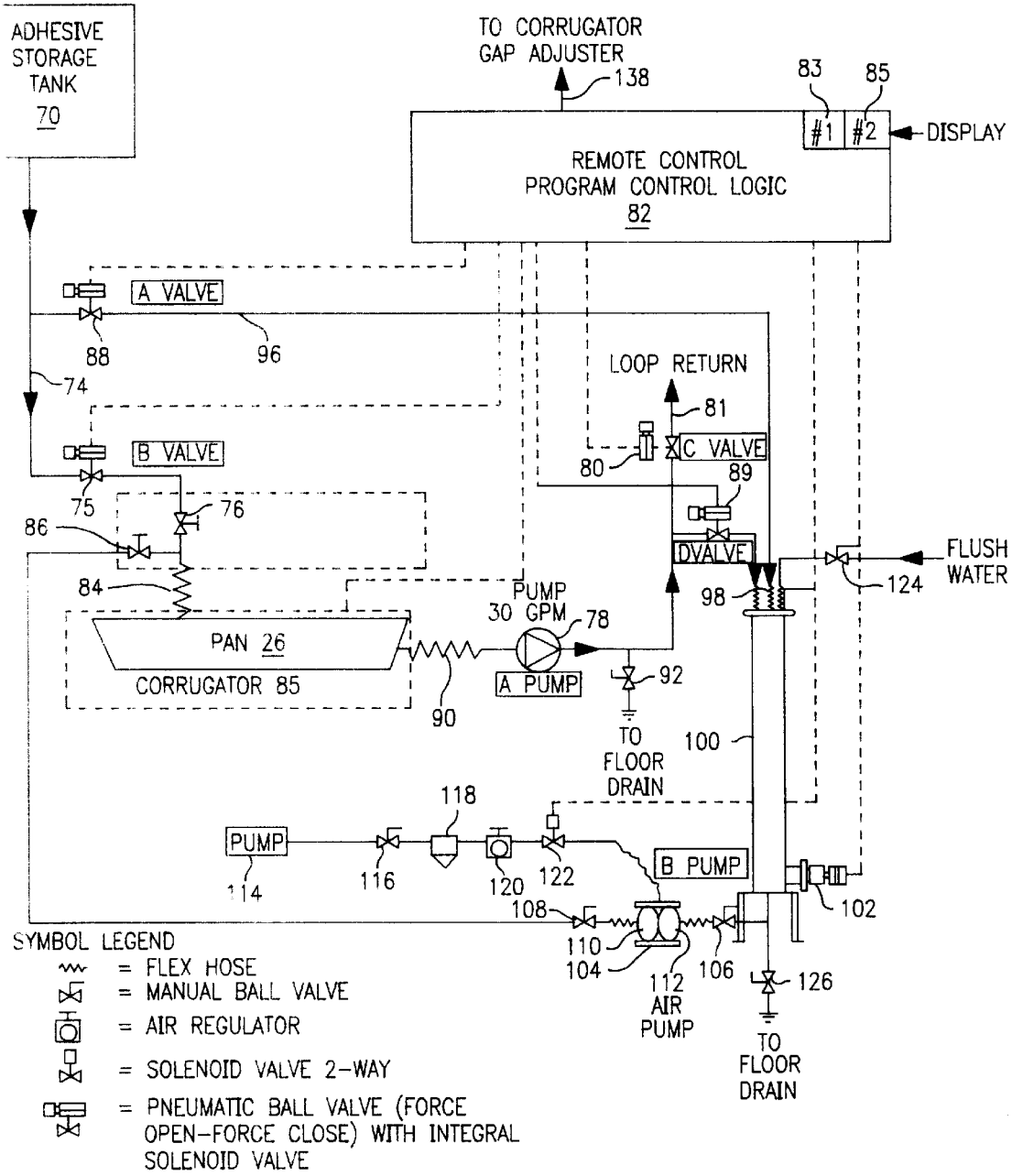
FIG. 6 shows the inventive system for monitoring the consumption and controlling a flow of adhesive to the corrugator.

The inventive adhesive consumption monitoring system is shown in FIG. 6 where the adhesive is normally delivered during production via a closed loop from any suitable source, such as a tank 70, through pipe 74, valves 75, 76, pan 24 or 26 (FIG. 1), consumption pump 78, valve 80 and return to tank 70 via a pipe 81. The delivery of adhesive to the corrugator pan 26 is under control of a suitable remote control program control logic circuit 82. A suitable digital display #1, #2 83, 85 gives a continuous reading of system parameters.

During normal operation, the adhesive flows from tank 70 through pipes 74, valves 75, 76, and through a flexible hose 84 to the pan 26 of corrugator 85. Valves 76, 86 may be manually operated in order to start an adhesive consumption test cycle. Valves 75, 88, 89 are operated by solenoids under control of the program logic 82. Once the level of adhesive in pan 26 is raised high enough, a consumption pump 78 operates to pump the adhesive through a flexible hose 90, consumption pump 78, and solenoid controlled valve 80 to return it to adhesive tank 70 during normal production or through valve 89 to column 100 during an adhesive consumption test run. If the manual valve 92 is opened, the adhesive is discarded when it is diverted to a suitable floor drain.

At various times, especially on start up of a corrugator 85, it is desirable to run a test that measures the amount of adhesive that is consumed as it is applied to the crests of the flutes. An optimum gap 54 (FIG. 1A) or at 50, 40 (FIG. 1) setting exists when the corrugator running speed and the amount of applied adhesive are in balance. Too little adhesive causes problems (such as de-lamination) as does too much adhesive (such as warpage or a reduction in corrugator speed). The problem is also compounded by the desire to run the corrugator at different speeds for different production runs. For example, the gap setting at 400 feet per minute has to change from the gap setting at 800 feet per minute, due to splashing and the rate of applied adhesive. Similar problems exist at other corrugator speeds.

Figure 7:
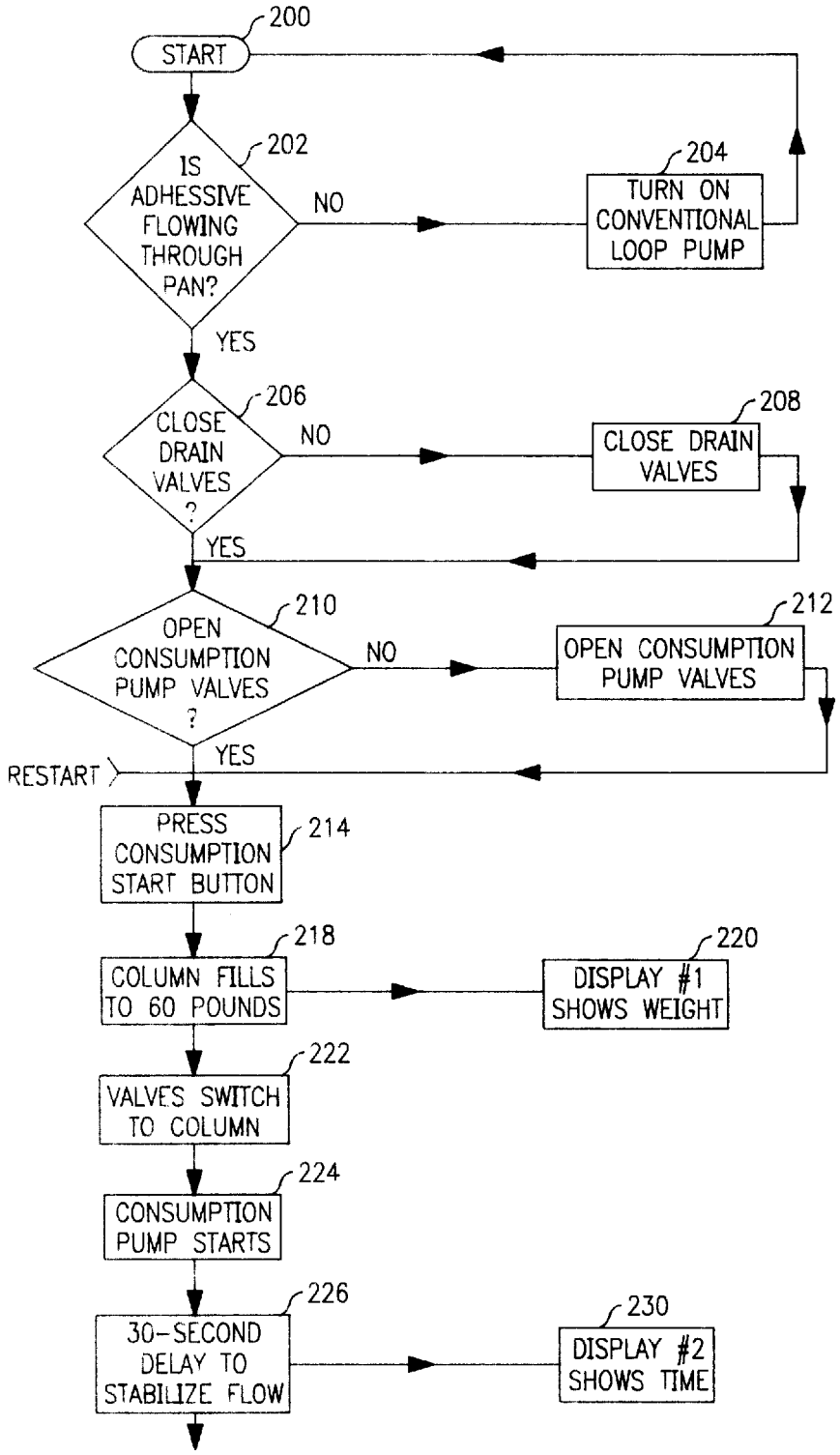
FIGS. 7 and 8 are a flow chart showing the steps exercised by a remote control program control logic circuit.
Figure 8:
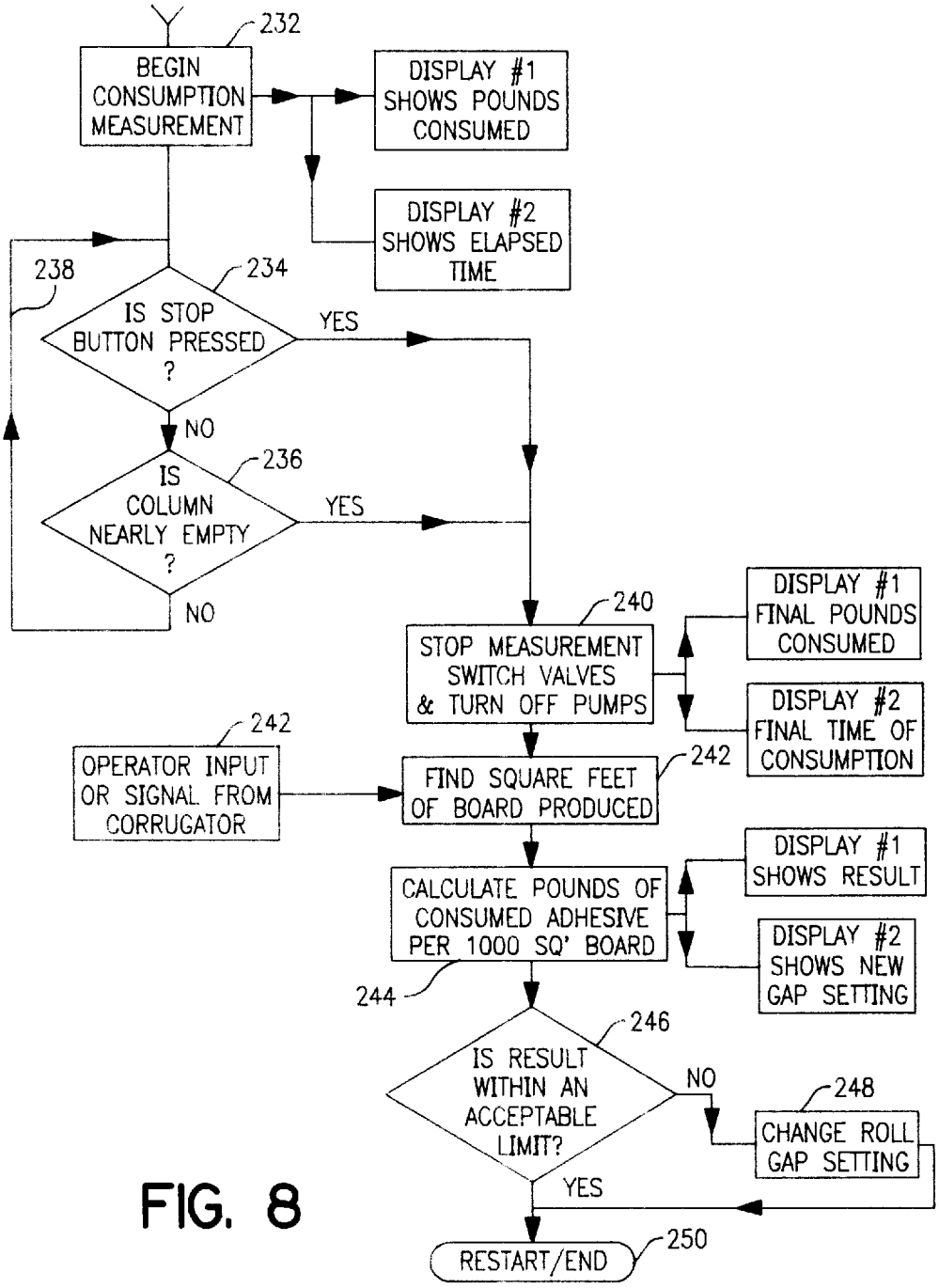

In order to run an adhesive consumption test, the logic circuit 82 follows the program set forth in the flow chart of FIGS. 7, 8. Solenoid controlled valve 88 is opened. The adhesive flows from tank 70 through valve 88, pipe 96 and flexible hose 98 to a graduated column 100 which fills with adhesive. As the column 100 fills, a detector 102, in effect, continuously measures the weight of the adhesive in the column. When the weight (60-pounds in one example) reaches a predetermined threshold level, the exact amount of adhesive in column 100 is known and valve 88 closes. At this point in the program, a 30-second time delay is built into the system to let the adhesive settle in the column.

Next, valves 75 and 88 are closed so that adhesive can no longer flow from tank 70 to the corrugator pan 26. Instead, valve 122 opens and compressed air flows to a pump 104 which initiates and sustains a flow of the adhesive from column 100 to pan 26. Air driven pump 104 drives the adhesive from column 100 through manual valves 106, 108, 86, and flexible hose 84 to the pan 26. The air driven pump 104 has two chambers 110, 112 which alternately expand and contract in a two cycle operation. In a first cycle, chamber 112 expands to draw adhesive from column 100 by way of valve 106 while chamber 110 contracts to drive adhesive into pan 26. During the second cycle, chamber 112 contracts while chamber 110 expands in order to transfer the adhesive from chamber 112 to chamber 110. Then the first cycle repeats.

The pump 104 is operated by compressed air delivered from a pump 114 through a manual valve 116, a filter and regulator 118, an air pressure regulator 120, and a solenoid controlled metering valve 122 which controls the amount of air and, therefore, the amount of adhesive flowing from the column 100 to the pan 26. The consumption pump 78 continues to operate so that adhesive in pan 26 is returned through valve 82 to column 100. Adhesive continues to flow through this closed loop as long as the adhesive consumption test is being run.

After a predetermined amount of adhesive has been delivered from column 100 to the corrugator pan 26, the weight of the adhesive in column 100, detected at 102, drops to a level which causes the air pump 104 to stop, which terminates the flow of adhesive from column 100 into pan 26. Valve 75 opens and the adhesive resumes flowing from tank 70 to pan 26. From a sensing of the time required for the measured amount of adhesive to be delivered from column 100 to pan 26 and from the known speed of the corrugator 85, it is easy to calculate the rate of consumption of the adhesive.

The described test may be repeated at any time depending upon the needs of the system; however, the most common time for testing is on start up of the corrugators 85.

After the testing is completed, valves 124, 126 are opened and flushing water runs through the column 100 in order to clean it. The flushing is repeated until the water running through valve 126 is clean and then valves 124, 126 are shut.

The above described operation is carried out under the control of a program control logic circuit 82, which is basically a microprocessor that has been programmed to control the system. The logic circuit may also automatically control a servo system 58 to adjust the gap between application roller 50 and an associated metering roller 40. Dashed lines are used in FIG. 6 in order to show the lines of communication between the logic circuit 82 and the various valves and sensors.

The operation of the remote control program control logic circuit 82 is shown by the flow chart in FIGS. 7 and 8.

The adhesive consumption monitoring system is turned on at step 200. A test is run at step 202 to determine whether adhesive is flowing from tank 70, through the loop of pipe 74, valves 75 and 76, pan 26, consumption pump 78, and valve 80 to return tank 70 via pipe 81. If the adhesive is not flowing, pump 78 is turned on at step 204.

If the adhesive is flowing, a test is run at step 206 to determine whether drain valves 92, 126 are closed. If they are not closed, the drain valves 92, 126 are closed at step 208.

If the drain valves are closed, a test is run at step 210 to be sure that all of the valves in the consumption line of the corrugator are open. If they are not open, a command to open the valves is given at step 212 and the system may be restarted if there are problems and some valves have not been set properly.

After all of the steps 202–212 have been successfully completed, the adhesive consumption monitoring system is ready and a start button is pushed at step 214 in order to begin the test run. Valves 88 and 89 open at step 218 to fill the column 100 with adhesives. As the column fills, sensor 102 sends a signal in step 222 which causes display #1 83 to show the weight of adhesive in column 100, as indicated at step 221.

When sensor 102 indicates that a selected predetermined weight (here 60 pounds) has been reached in step 218, the control logic 82 switches from a consumption of adhesive flowing in the main loop from tank 70 to the adhesive drawn from the column 100. That is, valves 75, 76 and 80 close while valves 122 and 89 open so that adhesive flows around the test loop column 100, valve 106, air pump 104, valves 108, 86, pan 26, consumption pump 78, and valve 89 to column 100. At step 224, the pumps 104 and 78 start or continue running if they are already doing so.

At step 226, there is a thirty second delay in order to stabilize the flow of adhesive from column 100. At this time, display #2 85 begins to display the time during which the consumption test is run, as indicated at step 230.

At step 232, the measurement of the consumption of adhesive begins. Display #1 83 continuously indicates the amount of adhesive that is consumed, while display #2 85 continuously indicates the elapse of time.

At step 234, the logic circuit 82 continuously monitors for the operation of a stop button and at step 236 continuously monitors for a low level of adhesive in column 100. As long as the stop button is not pushed and the low level of adhesive has not been reached, the logic circuit recycles steps 234, 236, as indicated at 238.

If either a stop button is pushed or the sensor 102 indicates a low level of adhesive in column 100, logic circuit 82 gives a stop consumption measurement signal, operates valves to close the adhesive test loop from column 100, and switches off the pumps 78, 104, at step 240.

When the consumption measurement test stops, displays #1 and #2 also stop, giving final readings of the total amount of adhesive consumed and of the time span during which the consumption test was run.

At step 242, either an operator manually or the corrugator automatically gives a signal which starts a calculation that first finds the total amount of corrugated cardboard produced and, at step 244, calculates the amount of adhesive consumed per thousand square feet of corrugated board.

At this time, the display #1 83 shows the results of the calculation that were made in step 244 while display #2 85 shows a new setting for the gaps between the application and the metering rollers. At the next step 246, a test is made to determine whether the new gap setting is within an acceptable tolerance range of the existing gap setting. If not, either an operator sets the gap by a manual control device 56 (FIG. 1A) or the logic circuit 82 automatically operates the servo system 58 (FIG. 1) to set the indicated new gap, at step 248.

If the gap is within the acceptable tolerance limits the consumption monitoring procedures end at step 250. If the gap is changed, the test sequence restarts at step 250.

After the adhesive is exhausted from the column 100, the procedure may be repeated any suitable number of times, until the corrugator is correctly set for producing the desired corrugated board. In greater detail, once the adhesive begins to flow from column 100 to pan 26, the system waits for one of the following events: (a) consumption of a prescribed amount of adhesive from column 100 (30 to 40-pounds, in one example); (b) the adhesive in column 100 is nearly exhausted (down to 5-pounds, in one example); (c) an elapse of a selected maximum time period (900-seconds, in one example); or (d) a manual end of test signal is given.

Figure 1B:
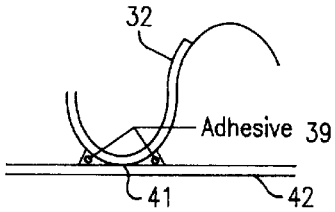
FIG. 1B shows the correct amount of adhesive on a crest of a flute.
Figure 2:
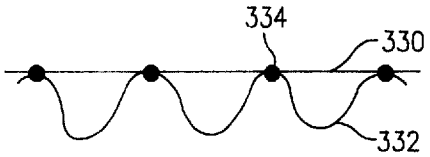
FIGS. 2–5 show, by way of example, four separate forms of corrugated paper which might be made on a corrugator using the inventive adhesive consumption monitor system.
Figure 3:
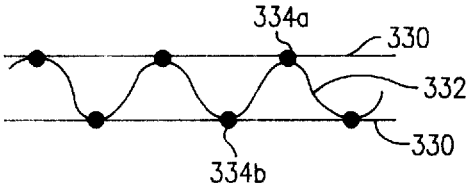
Figure 4:
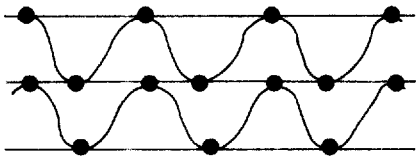
Figure 5:
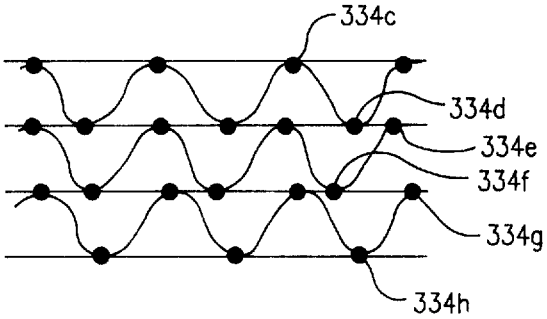

Corrugating machines are designed to make a number of different products such as relatively lightweight material (FIG. 2), as for internal dividers within a box; conventional double liner material (FIG. 3) for corrugated board boxes, and a variety of pads (FIGS. 4, 5) to protect a product and to keep it from being crushed. Each of these FIGS. 2–5 show a smooth liner (such as 330) and a corrugated sheet of paper (such as 332) which are glued together by an adhesive material (such as 334) applied onto the crests of the corrugations, as shown by heavily inked dots (such as 334)—see also FIG. 1B.

As is apparent from an inspection of FIGS. 2–5, there is a different requirement for delivering adhesive material to each of these types of corrugated board. For the single face board of FIG. 2, adhesive 334 is delivered from one pan 26 at a single location. For the double face board, the adhesive is delivered from two pans 26 at two different locations 334*a*, 334*b*. On the other hand, the double wall material (FIG. 4) and triple wall material (FIG. 5) require a delivery of adhesive from pans at four and six (respectively) different locations.

One approach is to share common equipment by providing a single column 100 and its associated set of support equipment which are accessed through a common matrix of pipes and valves for selectively conveying adhesive to pans 26 at one or more locations, depending upon the kind of corrugated material that is being run at any given time. However, since the adhesive is warm when used, and since the heat generated by the corrugator further heats the adhesive, there is a need for controlling the heat of these pipes and valves which may make this use of a common matrix unattractive.

Another approach is to duplicate the equipment of FIG. 6 (primarily the graduated column 100 and its associated support equipment) for each pan location. While this approach requires up to six different duplications of equipment, it is simple and easy to use and control, as compared to a complicated matrix of pipes and valves for sharing common equipment.

Of course, a third approach is to provide a combination of some common equipment accessed via a matrix of pipes and valves and some duplicated equipment. The invention contemplates using all three of these approaches since different corrugating systems have different needs.

In operation, the system of FIG. 6 monitors the consumption of adhesive during the manufacture of corrugated board. During a production run, the adhesive is delivered through a main closed loop from a tank 70 containing adhesive via a system of pipes and valves 74–80 to a pan 26 and return to tank 70. An application roller 38 or 50 (FIG. 1) picks up the adhesive in the pan and delivers it to the crests of the corrugated paper.

A graduated column 100 (FIG. 6) also receives adhesive via the system of pipes. Sensor 102 detects high and low limits of adhesive by, in effect, weighing the adhesive in column 100. At a high limit, the delivery of adhesive from source 70 is switched off at valve 75 and a delivery of adhesive from column 100 is directed through a test loop into pan 26 at valves 106, 108, 86, under control of a solenoid operated valve 122 which applies compressed air to pump 104. The resulting delivery of adhesive from column 100 to pan 26 is controlled from the remote controller 82 as it operates valve 122. At the low limit, the process is reversed when valve 122 shuts to end the delivery of adhesive from column 100. Then the manual valves 106, 108, 86 are switched off. The delivery of adhesive from tank 70 to pan 26 is switched on at valves 75, 88.

The amount of adhesive 134 deposited on the crest of each flute on the corrugated paper is known from a detection of the period of time required for the column 100 to deliver a known amount of adhesive and to a detection of the amount of corrugated board made during that period of time.

Those who are skilled in the art will readily perceive how to modify the invention. Therefore, the appended claims are to be construed to cover all equivalent structures which fall within the true scope and spirit of the invention.

The claim invention is:

1. In a corrugator a system for monitoring a consumption of adhesive comprising: a source of adhesive, a pan for receiving said adhesive from said source, a system of pipes and valves for delivering said adhesive from said source to said pan, means for applying adhesive from said pan in limited amounts to crests of corrugated paper flutes, means for monitoring an application of adhesive to said crests comprising a graduated column for storing a known volume of said adhesive, sensor means associated with said graduated column for detecting upper and lower limits of said volume of adhesive stored therein, means responsive to said detection of said upper limit for substituting a delivery of said adhesive from said graduated column to said pan for said delivery of adhesive from said source via said system of pipes and valves to said pan, means responsive to said detection of said lower limit for returning said delivery of said adhesive from said graduating column to said source via said system of pipes and valves, and adhesive consumption detecting means jointly responsive to an amount of adhesive delivered from said column and to an amount of corrugated board manufactured during an interval while said adhesive is being delivered from said graduated column for determining the amount of adhesive applied to the crests of said paper flutes.

2. The system of claim 1 further comprising means responsive to said adhesive consumption detection means for enabling an adjustment of a gap between said adhesive applying means and a metering means.

3. The system of claim 2 further comprising manual means for adjusting said gap.

4. The system of claim 2 further comprising a servo system coupled to control said gap, and means for adjusting said gap by automatically driving said servo system to select said gap in response to said detection of adhesive consumption.

5. The system of claim 1 further comprising a pump interposed between said graduated column and said pan for delivering adhesive from said column to said pan, and means for selectively operating said pump in response to said detection of said upper and lower limits.

6. The system of claim 5 wherein said pump has two chambers driven by compressed air, one of said chambers sucking adhesive from said column and the other of said chambers driving said sucked-in adhesive to said pan.

7. An adhesive delivery system and a corrugator machine, said system comprising a closed loop for delivering adhesive from a source through a pan and return to the source, said adhesive being delivered from said pan to said corrugator machine, a graduated chamber having a level detector associated therewith, means for delivering said adhesive to said chamber, means responsive to said level detector for terminating delivery of adhesive through said closed loop and for sending a known amount of adhesive from said chamber to said pan, means for detecting the amount of time required to deliver said known amount of adhesive from said chamber to said pan, and means for detecting an amount of corrugated board produced by said known amount of adhesive, thereby indicating the rate of adhesive consumption by said corrugating machine.

8. The system of claim 7 wherein said rate of adhesive consumption depends upon a gap in said corrugator machine, and said system further comprises means responsive to said measuring means for adjusting said gap.

9. The system of claim 7 and a remote controller comprising program control logic circuits for coordinating an operation of said system.

* * * * *